US005657559A

United States Patent [19]

Immel

[11] Patent Number: 5,657,559

[45] Date of Patent: Aug. 19, 1997

[54] RIGGING ASSEMBLY FOR AN EXCAVATING BUCKET

[75] Inventor: Darryl R. Immel, Waterford, Wis.

[73] Assignee: Harnischfeger Corporation, Brookfield, Wis.

[21] Appl. No.: 563,010

[22] Filed: Nov. 24, 1995

[51] Int. Cl.[6] ..... E02F 3/48

[52] U.S. Cl. ..... 37/394; 37/399; 294/68.27

[58] Field of Search ..... 37/394, 396, 397, 37/398, 399, 401; 294/68.3, 68.27, 68.26, 68.22

[56] References Cited

U.S. PATENT DOCUMENTS

| | | | |
|---|---|---|---|
| 956,936 | 4/1910 | Crenshaw | 37/396 |
| 966,313 | 8/1910 | Crenshaw | 37/396 |
| 1,006,931 | 10/1911 | Gibb et al. | 294/68.26 |
| 1,080,292 | 12/1913 | Morris | 37/396 |
| 1,879,448 | 9/1932 | Page | 37/398 |
| 2,334,460 | 11/1943 | Weimer | 37/396 |
| 2,341,838 | 2/1944 | Bager | 37/396 |
| 3,531,088 | 9/1970 | Kraschnewski | 37/399 X |
| 3,541,710 | 11/1970 | Sankey et al. | 37/396 |
| 3,606,438 | 9/1971 | Feczko | 294/68.27 |
| 5,367,798 | 11/1994 | Hughes | 37/397 X |

FOREIGN PATENT DOCUMENTS

| | | | |
|---|---|---|---|
| 541939 | 1/1977 | U.S.S.R. | 37/396 |

OTHER PUBLICATIONS

Brochure:Page Engineering Company, Wedgebak Archless in Action, Classified in 37/398 No Date.

*Primary Examiner*—Randolph A. Reese
*Assistant Examiner*—Thomas A. Beach
*Attorney, Agent, or Firm*—Jansson & Shupe, Ltd.

[57] ABSTRACT

A rigging assembly for a dragline bucket has first and second hoist chains coupled to the bucket and first and second pickup links above the hoist chains. The chains extend along first and second axes, respectively, and define a fleet angle between them. In the improvement, the pickup links define a link angle between them which is substantially equal to the fleet angle. The pickup links are coupled with respect to respective hoist sockets by pins, the hoist chains are coupled with respect to the pickup links by other pins and all of the pins have substantially equal cross-sectional areas. Most preferably, the pins are identical to one another for parts "commonality."

3 Claims, 5 Drawing Sheets

RIGGING ASSEMBLY FOR AN EXCAVATING BUCKET

FIELD OF THE INVENTION

This invention relates generally to excavating and, more particularly, to digging and excavating machines and digging buckets used with such machines.

BACKGROUND OF THE INVENTION

Machines for digging and excavating are available in a wide variety of fundamental types and a variety of configurations within each type. For example, common types of digging and excavating machines include front end loaders, backhoes and scrapers.

Another type of excavating machine is known as a dragline. Draglines are often used for mining where the mineral being sought, e.g., coal or ore, is relatively close to the surface of the earth. A dragline is equipped with an extending boom from which is suspended a bucket.

To excavate, the dragline bucket is placed on the ground away from the machine. With its teeth rearward (facing the machine), such bucket is drawn (or "dragged") toward such machine by taut cable. When the bucket is filled, it is hoisted by other taut cables and the machine is then rotated to dump the bucket contents onto a pile.

The bucket is suspended from the end of the boom by parallel cables made of steel strands. (In outward appearance, such cables closely resemble manilla rope and such cables are referred to in this specification as ropes.) Such ropes extend downwardly from the end of the boom and are terminated at their lower ends by hoist sockets. A bucket rigging assembly extends downwardly from the sockets and attaches to the digging bucket. Known rigging assemblies include hoist chains, pickup links, dump blocks and other components which are discussed in the detailed description below. The chains diverge and define what is known as a "fleet angle" between them.

Buckets and their rigging assemblies can be (and usually are) very large and heavy. For example, dragline buckets having a capacity of 80 cubic yards, i.e., large enough to hold several automobiles, are relatively common. Empty, such buckets may weigh on the order of 45–50 tons and assuming that a cubic yard of material being excavated weighs 1800–2000 pounds, such buckets lift 75–80 tons of material on each digging cycle. The rigging assembly for an 80 yard bucket weighs on the order of 24 tons. Draglines with 150 yard buckets are not unheard of and the largest dragline bucket ever made has a capacity of 220 cubic yards. A large dragline can create a pile of excavated material that is 200 feet high or so.

There are several considerations applicable to dragline configuration and use and all relate directly or indirectly to cost of machine operation and machine availability, i.e., "up time" during which the machine is in good repair and available to excavate. One consideration is the dimension of the rigging assembly from the hoist sockets to the bottom of the bucket. The shorter the dimension, the greater the maximum height of the pile onto which the bucket can be dumped. This is not a trivial consideration—a difference of one foot in such dimension is significant. If a dragline can create a pile which is 201 feet high rather than 200 feet high, the volume of additional material in such pile will exceed 16,000 cubic yards, assuming an ideal cone-shaped pile and a material repose angle of 30°.

Another consideration is the fleet angle, i.e., the angle defined by the two diverging bucket hoist chains. The greater the fleet angle, the closer is each chain to a horizontal plane. And since the weight of the bucket acts vertically (under the force of gravity), greater fleet angles require heavier chains to support the bucket. (The reason such chains must be heavier and stronger is based upon a field of engineering mechanics known as "statics" and, specifically, force vector analysis.) And, of course, the boom must lift the combined weight of the rigging, bucket and material load—heavier chains detract from productive machine capacity.

(It is apparent from the foregoing—or will be after analyzing the entire specification—that a rigging assembly always represents a compromise between a reasonably modest fleet angle and acceptable vertical assembly dimension. To put it in other terms, fleet angle can be dramatically reduced but only at the expense of a substantially-increased vertical assembly dimension and vice versa.)

Yet another consideration of growing importance to dragline operators might be termed "parts proliferation" or the inverse, "parts commonality." For reasons relating to the cost of inventory, operators wish to stock as few repair parts as possible. And they prefer that parts serve any of several different functions.

In certain known rigging assemblies, some components are coupled to one another by a single pin which is required to support the entire weight of the bucket, the rigging assembly and the bucket contents. On the other hand, other components are coupled to one another by pins which, because of the assembly configuration, are required to support nominally one-half of the weight of the bucket, the rigging assembly and the bucket contents. Of course, the pins are of different sizes and pins of both sizes (rather than one size) must be kept in repair parts inventory.

Still another consideration relates to other parts of the rigging assembly known as dump blocks. A dump block resembles a pulley and, commonly, a dragline bucket rigging assembly has two dump blocks. A rope passing over each dump block is used when tilting the bucket from horizontal to vertical for bucket emptying. Prior art dump block arrangements require a degree of misalignment between the block and the rope that enters and leaves the block. At the least, undue rope wear results. And stress on the dump block is unnecessarily increased.

A new dragline bucket rigging assembly which addresses some of the problems and shortcomings of the prior art would be an important advance.

OBJECTS OF THE INVENTION

It is an object of the invention to provide an improved rigging assembly for a dragline bucket which overcomes some of the problems and shortcomings of the prior art.

Another object of the invention is to provide an improved rigging assembly which helps reduce inventory costs.

Another object of the invention is to provide an improved rigging assembly which has a reduced number of component parts.

Another object of the invention is to provide an improved rigging assembly which results in a smaller fleet angle.

Yet another object of the invention is to provide an improved rigging assembly which permits the assembly dump blocks to better align with the ropes passing therethrough.

Another object of the invention is to provide an improved rigging assembly which helps reduce dump block rope wear.

Still another object of the invention is to provide an improved rigging assembly in which the dimension of the rigging assembly from the hoist sockets to the bottom of the bucket is not increased over that of prior art assemblies.

Another object of the invention is to provide an improved rigging assembly which uses common pin parts at several locations in the assembly. How these and other objects are accomplished will become more apparent from the following descriptions and from the drawings.

SUMMARY OF THE INVENTION

The invention is an improvement in a dragline bucket rigging assembly having two hoist chains (i.e., first and second chains) coupled to a bucket and first and second pickup links above the hoist chains. The chains extend along first and second axes, respectively, and define a fleet angle between them. Like the chains, the pickup links are angled to one another and define what is termed a link angle between them. Such link angle is substantially equal to the fleet angle. Each of the hoist chains has an upper connection end and such ends are respectively coupled to the first and second pickup links. As will become more apparent, angling the pickup links to one another helps reduce the fleet angle, among other advantages.

The rigging assembly is suspended from a plurality of hoist ropes which extend downwardly from the end of the dragline boom and which are substantially parallel to one another and to a vertical reference plane. The pickup links are angled with respect to the hoist ropes as well as with respect to one another and each link and its respective hoist chain extend along a separate axis angled with respect to the reference plane.

In another aspect of the invention, the first pickup link is coupled with respect to a hoist socket by a first pin and, in turn, the first hoist chain is coupled with respect to that pickup link by a second pin. The pins have substantially equal cross-sectional areas and support nominally one-half of the total weight of the bucket, the rigging assembly and the bucket contents.

In a closely-similar arrangement in which the hoist chain comprises an upper chain and a lower chain, the upper and lower hoist chains are coupled with respect to one another by yet another pin.

For maximum parts commonality, all of the pins have substantially equal cross-sectional areas and that is entirely practical since all such pins are loaded to about the same degree. In a specific embodiment, the pins are identical to one another. This feature helps reduce the number and type of spare parts required to be kept on hand by the dragline operator. And most preferably, the assembly is free of a dump block equalizer bar and free of a common clevis supporting the chains. Such arrangement also aids in reducing parts inventory.

The new assembly also has advantages for dump block orientation and consequent reduced cable wear. Such assembly has first and second dump blocks attached to the first and second pickup links, respectively. The dump blocks are angled with respect to the above-noted vertical plane rather than being parallel thereto as in certain prior art configurations. Such dump block orientation has favorable implications at least for dump block rope wear.

Further details of the invention are set forth in the following detailed description and in the drawings.

DETAILED DESCRIPTION OF PREFERRED EMBODIMENTS

Before describing the new rigging assembly 10, it will be helpful to have an understanding of the general arrangement and operation of a dragline. That description will be followed by a description of certain prior art rigging assemblies and of the component parts and parts terminology commonly used with respect to dragline rigging assemblies.

Figure 1:
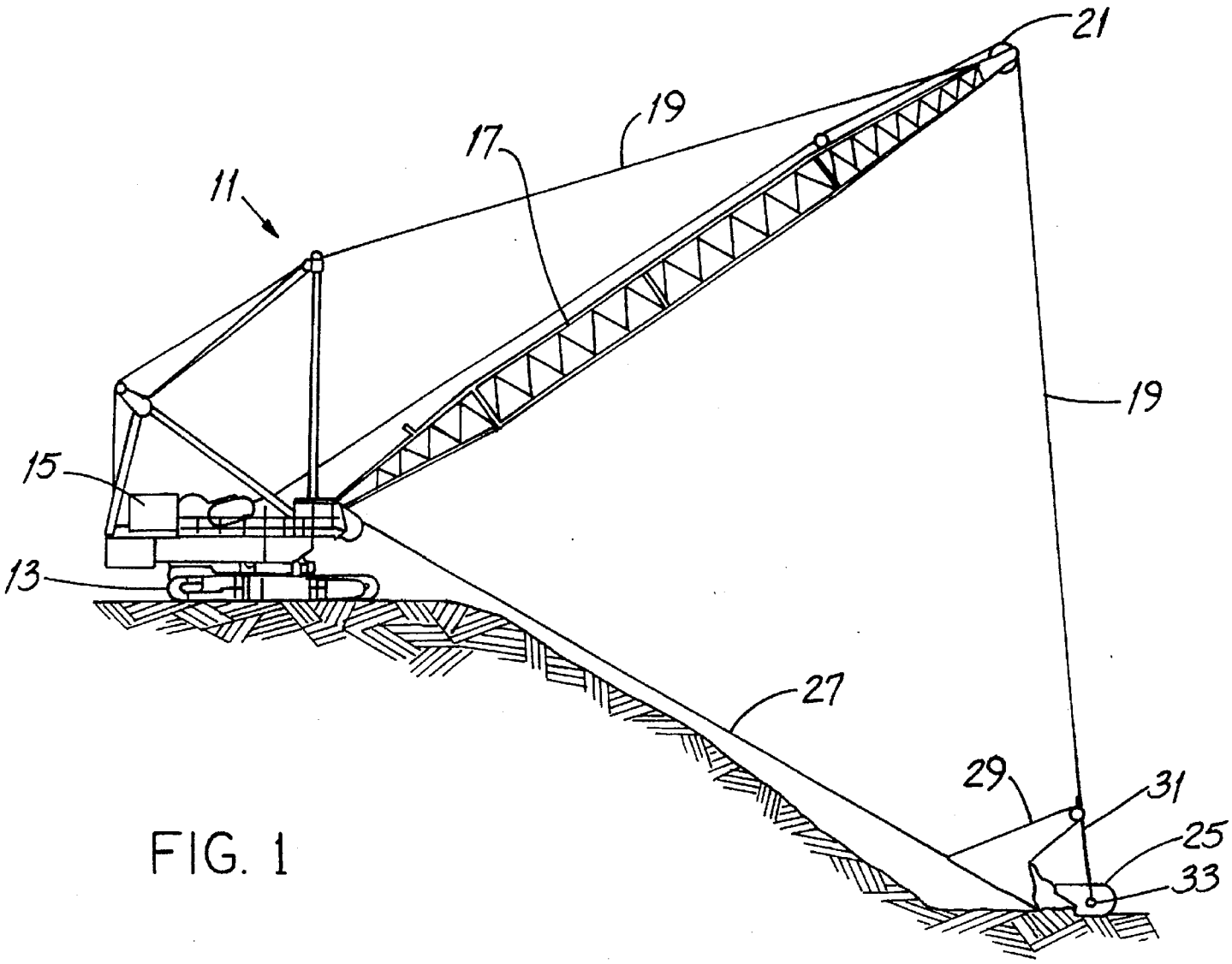
FIG. 1 is a representative side elevation view of a dragline, a example of a machine benefitted by the new rigging assembly.
Figure 10:
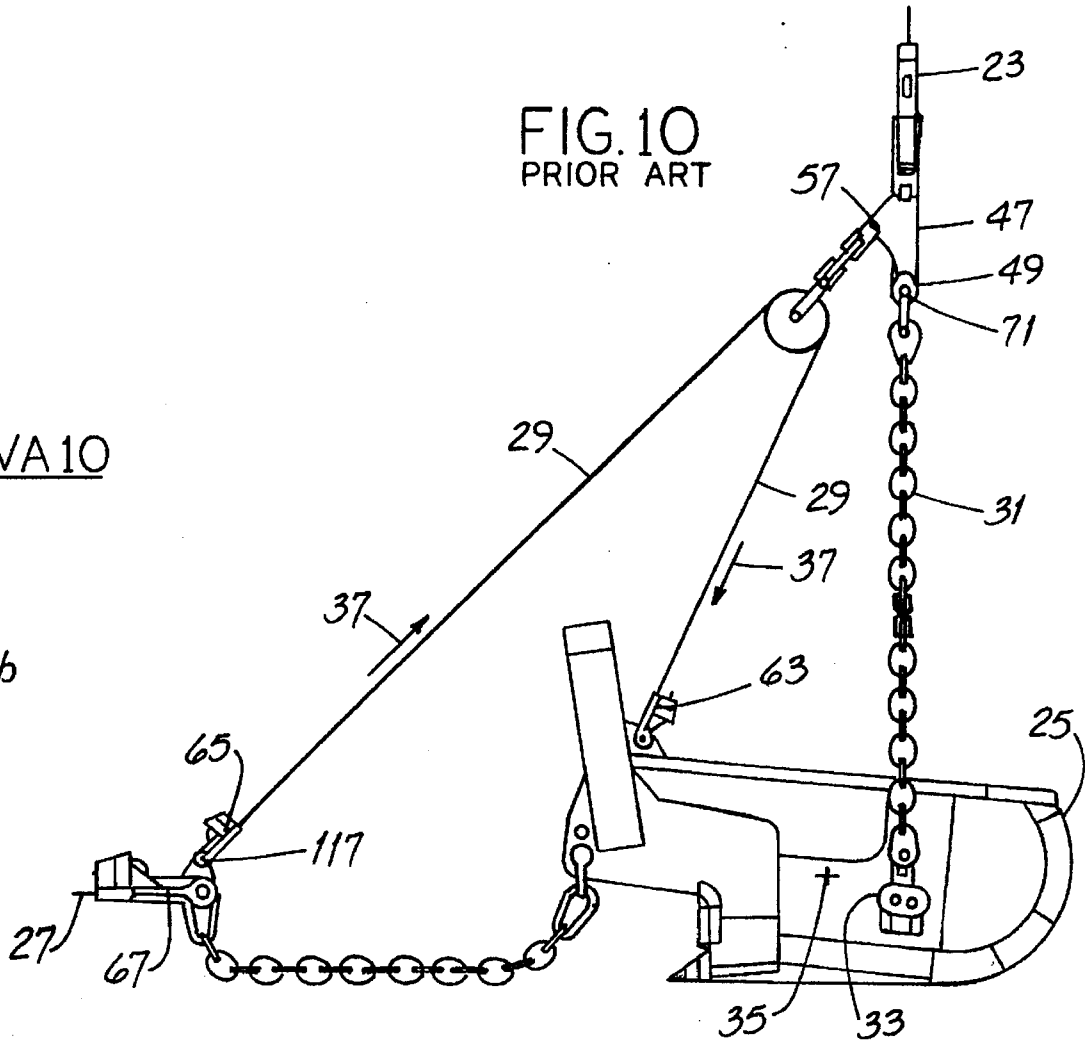
FIG. 10 PRIOR ART
FIG. 10 is a side elevation view of the assembly and bucket of FIG. 9 taken generally along the viewing axis VA10 thereof. Parts are broken away.
Figure 9:
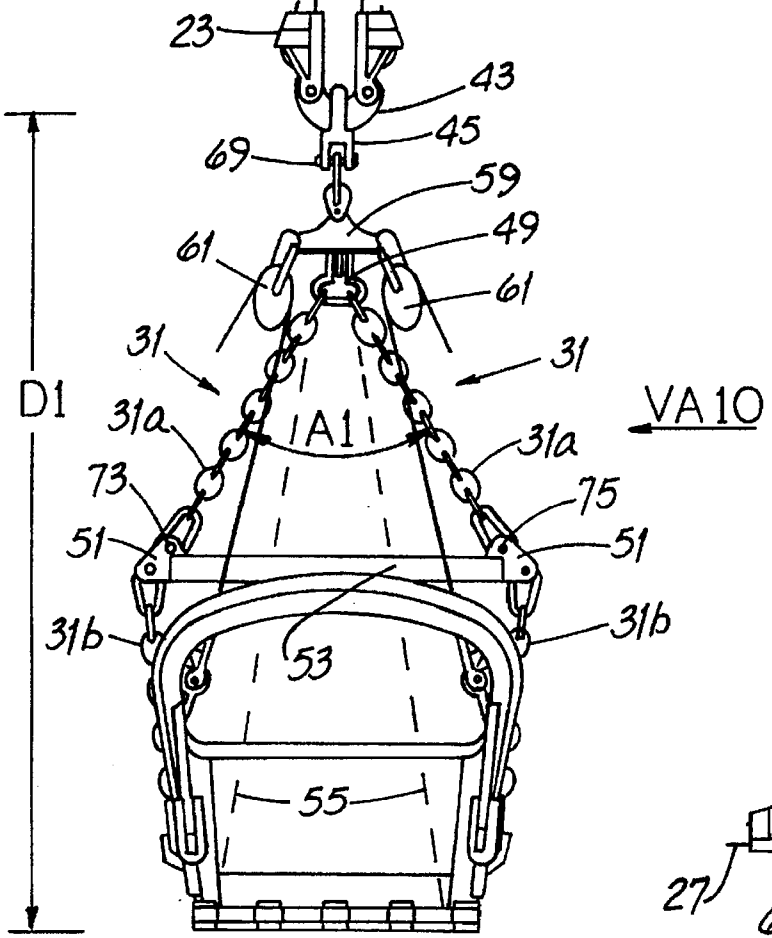
FIG. 9 PRIOR ART
FIG. 9 is a front elevation view of a prior art rigging assembly shown in conjunction with a digging bucket. Parts are broken away.

Referring to FIG. 1, a dragline 11 has crawlers 13 or "walk-legs" (not shown) used to move the machine from place to place. The upper works 15 pivots with respect to such crawlers 13 or walk-legs. A boom 17 extends from the upper works 15 and is reeved with hoist ropes 19 which pass over rotatable pulley-like sheaves 21 at the boom end. Referring also to FIGS. 9 and 10, at the rigging assembly, such ropes 19 are terminated by hoist sockets 23. The sockets 23 permit pin connections at what are, effectively, the ends of the ropes 19.

To excavate, the dragline bucket 25 is placed on the ground away from the dragline 11 as shown in FIG. 1. With its teeth rearward (facing the machine), such bucket 25 is drawn (or "dragged") toward such machine by the taut drag rope 27. During digging, the dump ropes 29 and the hoist chains 31 are somewhat slack. When the bucket 25 is filled, it is raised by the hoist ropes 19 and the upper works 15 is then pivoted to dump the bucket contents onto a pile.

During bucket hoisting, the dump ropes 29, drag ropes 27 and hoist chains 31 are all taut and to dump the bucket 25, tension is released on the drag ropes 27. Since the bucket trunnions 33 are well to the right (as viewed in FIG. 10) of the bucket center of gravity (represented by the mark 35), the bucket 25 rotates counterclockwise of its own weight (and that of its load) with the dump ropes 29 moving in the direction of the arrows 37 as it does so. (From the foregoing, it is apparent that the primary function of the dump ropes 29 is to control the position, horizontal or vertical, of the bucket 25.)

Aspects of Rigging Assemblies Including Prior Art Assemblies

Component parts of a dragline bucket rigging assembly 10 or 79 will now be described. Each of the hoist sockets 23 is pin-connected to a hoist socket equalizer 43. Such equalizer 43 keeps the ropes 19 parallel to one another and generally aligned with the sheaves 21 at the end of the boom 17.

A hoist link 45 is connected to the equalizer 43 and the lower portion of such link 45 is pin-connected to the upper end of a pickup link 47. The lower end of the link 47 has a bottom clevis 49 mounted thereon and both hoist chains 31 are attached to such clevis 49. The angle A1 between the chains 31 is referred to as the fleet angle.

In the illustrated version of FIGS. 9 and 10, each of the hoist chains 31 includes an upper chain 31*a* and a lower chain 31*b* which are coupled together at an attachment portion 51 of a rigid spreader bar 53. Such bar 53 extends horizontally between the attachment portions 51, thereby holding the lower chains 31*b* at generally vertical positions to span the outside of the bucket 25. In an alternate arrangement which has no spreader bar, the chains 31 extend along the dashed lines 55 and attach to the inside of the bucket 25 rather than to the outside.

The link 47 has an intermediate connection point 57 having a dump block equalizer 59 pin-connected thereto. Attached to each lateral end of the equalizer is a separate pulley-like dump block 61. An end 63 of each rope 29 is attached to the bucket 25 by a socket and the other end 65 of each rope 29 is attached to a drag yoke 67, also by a socket.

Certain aspects of the assembly of FIG. 9 should be noted. One is the vertical dimension D1 from the socket equalizer to the bottom of the bucket. Another is the magnitude of the fleet angle A1. Such dimension D1 and angle A1 are referred to by way of comparison in the discussion of the inventive assembly 10.

Another aspect to be noted in the assembly of FIG. 9 is that the pins 69 and 71 "work" under the entire weight of the hoist chains 31, the bucket 25 and the material in the bucket 25. On the other hand, the pins 73 and 75 work (nominally) under only one-half of the weight of such chains 31, bucket 25 and material. In consequence, the pins 69 and 71 must be (and are) much larger and of substantially greater cross-sectional area than the pins 73 and 75. To assure ready availability of repair parts, the dragline operator is required to stock both sizes of pins 69, 71, 73, 75.

Figure 11:
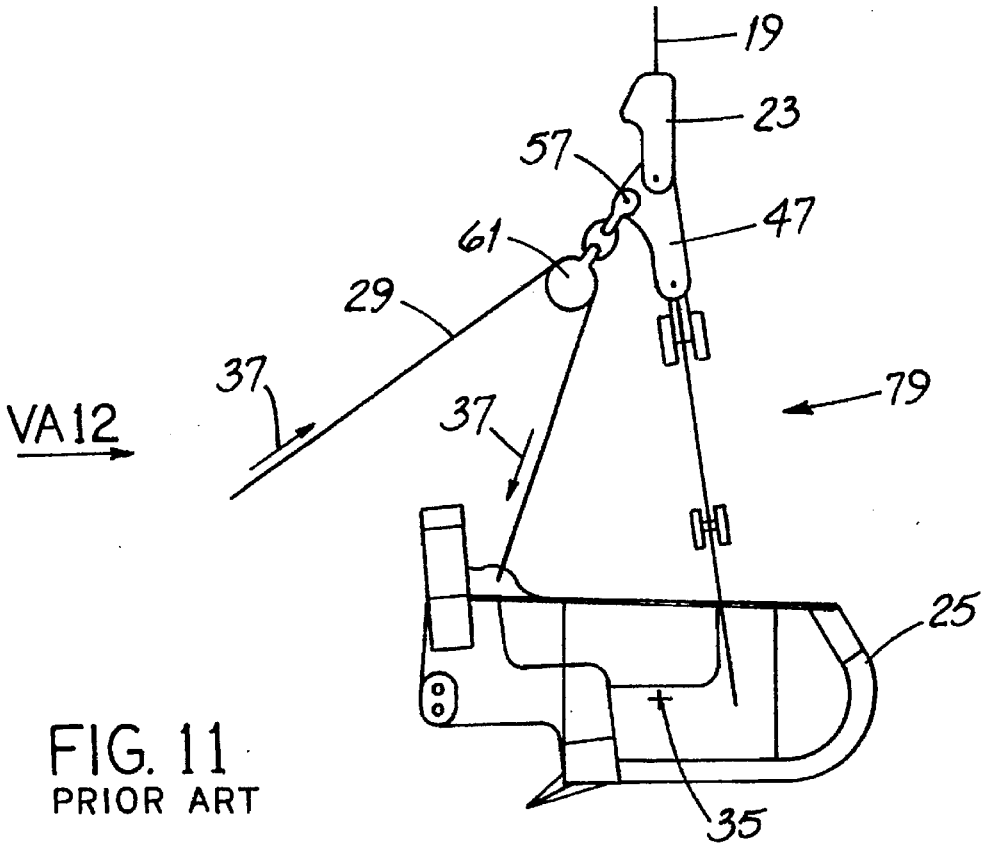
FIG. 11 PRIOR ART
FIG. 11 is a simplified side elevation view of another prior art rigging assembly shown in conjunction with a digging bucket. Parts are broken away.
Figure 12:
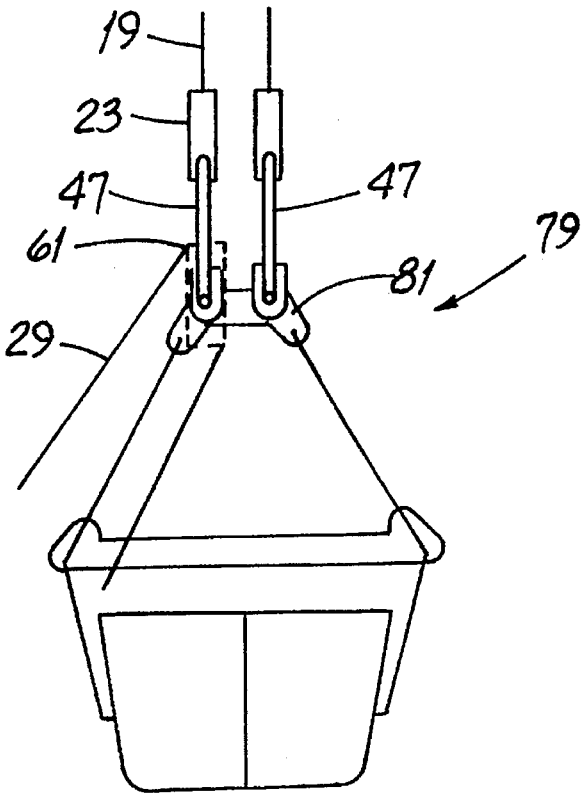
FIG. 12 PRIOR ART
FIG. 12 is a simplified front elevation view of the rigging assembly and bucket of FIG. 11 taken generally along the viewing axis VA12 thereof. Parts are broken away.

Another prior art rigging assembly 79 is shown in FIGS. 11 and 12 includes two parallel pickup links 47, the upper ends of which are pin-connected to respective hoist sockets 23. The lower ends of such links 47 are pin-connected to a lower equalizer 81 having two lateral arms pin-connected to respective hoist chains 31. A separate dump block 61 is pin-connected to the intermediate point 57 of each pickup link 47 although only one such dump block 61 is shown.

From FIG. 12 and a comparison with FIG. 9, it is apparent that the dump blocks 61 are not particularly well oriented with respect to the axis of the rope 29 passing around it. That is to say, dump block orientation is such that the rope 29 enters and leaves the block pulley at some angle. And the forces on the rope are angular to the pulley. As a result, the rope and the pulley chafe and abrade one another. In that respect, the version of FIG. 12 is more adverse to acceptable dump block and block rope life than that of FIG. 9.

The New Rigging Assembly

Figure 3:
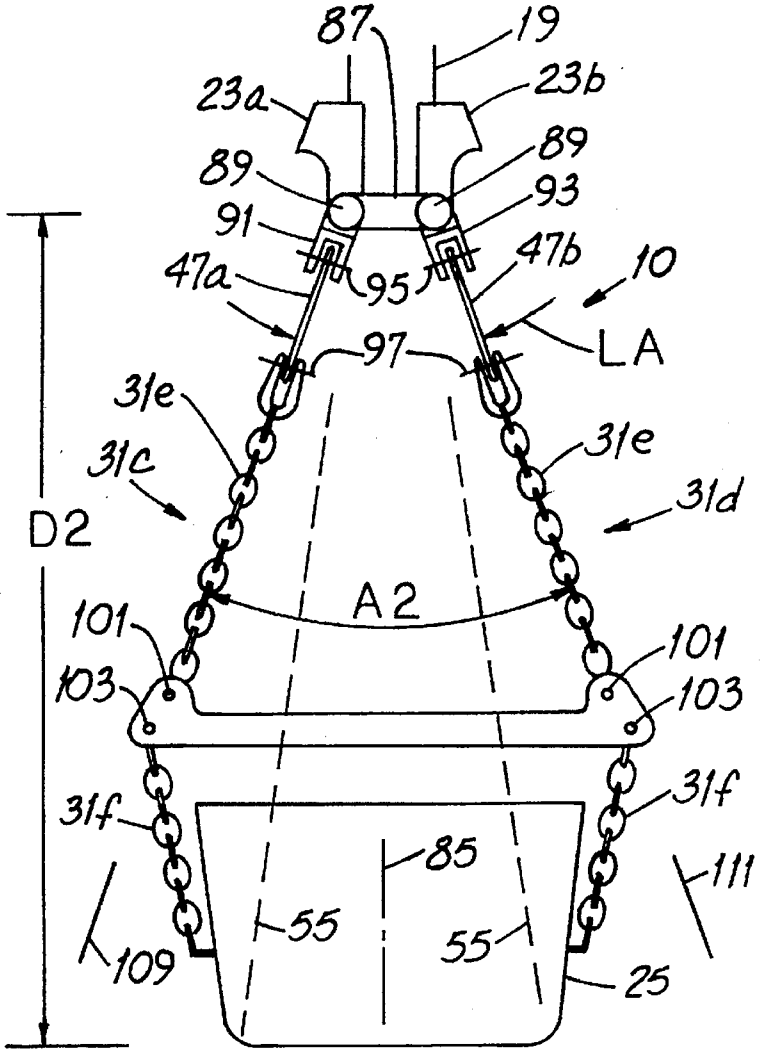
FIG. 3 is a front elevation view of the new rigging assembly and bucket of FIG. 2 taken generally along the viewing axis VA3 thereof. Parts are broken away.
Figure 2:
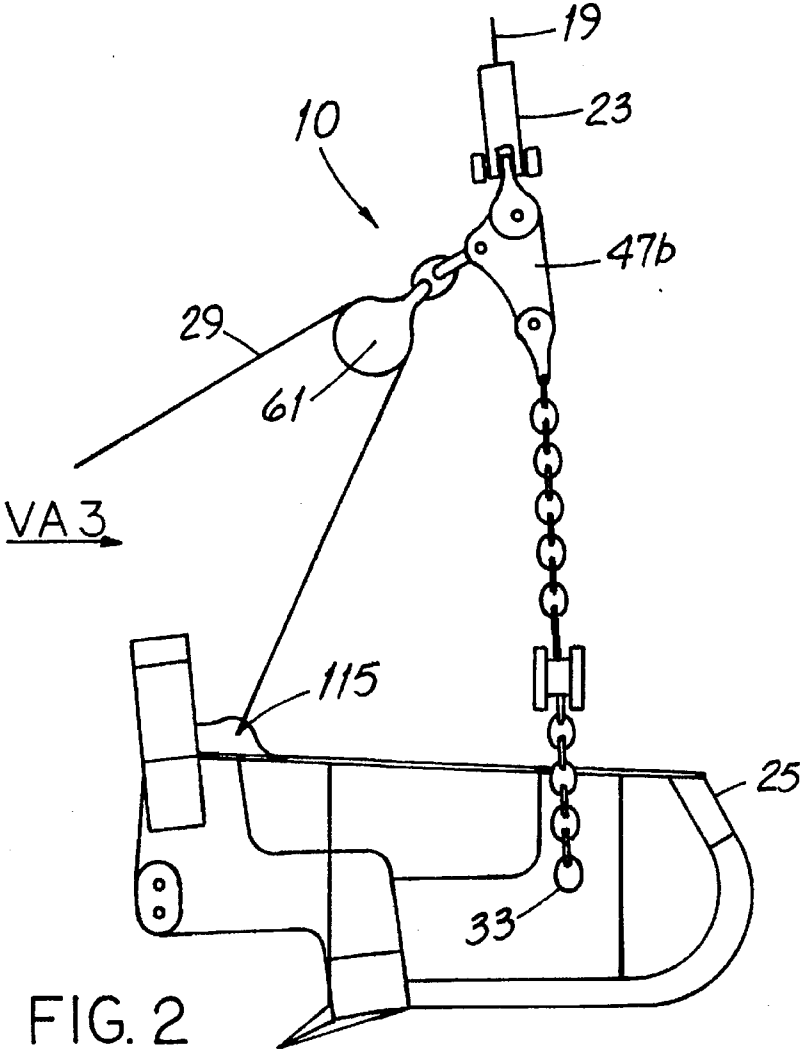
FIG. 2 is a side elevation view of the new rigging assembly shown in conjunction with a digging bucket. Parts are broken away.

Referring now to FIGS. 2 and 3, the new rigging assembly 10 will now be described. The rigging assembly 10 is suspended from a plurality of hoist ropes 19 which extend downwardly from the end of the dragline boom 17 and which are substantially parallel to one another and to a vertical reference plane 85. Each rope 19 terminates in a hoist socket 23, the ends of which are connected by pins 89 to a tension link 87.

Below the tension link 87 are first and second twisted links 91 and 93, respectively. Such twisted links 91, 93 are so named because the pin 95 at the lower end of each is about at 90° to the pin 89 at the upper end of each. The twisted links 91, 93 may be separate parts or formed integrally with the tension link 87. The assembly 10 also has first and second pickup links 47*a*, 47*b*, respectively, which are coupled with respect to the first and second hoist sockets 23*a*, 23*b* by a set of first pins 95, one first pin 95 for each pickup link 47*a*, 47*b*.

In turn, the first and second hoist chains 31*c*, 31*d* are coupled with respect to the first and second pickup links 47*a*, 47*b*, respectively, by a set of second pins 97, one second pin 97 for each hoist chain 31*c*, 31*d*. As represented by FIGS. 4, 5, 6 and 7, the pins 85, 95, 97 have substantially equal cross-sectional areas 99 and support nominally one-half of the total weight of the bucket 25, the rigging assembly 10 and the bucket contents.

In the assembly 10 shown in solid outline in FIG. 3, the first and second chains 31*c*, 31*d* each include an upper hoist chain 31*e* and a lower hoist chain 31*f*. And when such first and second chains 31*c*, 31*d* (as represented by the dashed lines 55) extend in straight lines and connect to the inside of the bucket 25, each hoist chain 31*c*, 31*d* has but a single length of chain.

Referring also to FIGS. 4–7, the upper and lower chains 31*e*, 31*f* are pin-connected with respect to one another by a set of third pins 101, and a set of fourth pins 103. It is to be appreciated that like the first and second pins 95, 97 the third and fourth pins 101, 103 support nominally one-half of the total weight described above. Therefore, it is highly preferred that all pins 95, 97, 101, 103 have substantially equal cross-sectional areas (preferably circular) and be substantially identical to one another. (To avoid redundancy, a fourth pin 103 is not shown but is substantially identical in area 99 to those pins 89, 95, 97, 101 shown in FIGS. 4–7.)

From the foregoing and an inspection of the FIGURES, it is apparent that in the inventive assembly 10, all of the pins 95, 97, 101, 103 may have the same diameter and, in fact, be substantially identical to one another because each of all such pins 95, 97, 101, 103 work under only one-half of the weight of such chains 31, bucket 25 and material. This represents a major improvement over prior art versions which require differing sizes of pins, e.g., pins 69, 71 carry full weight and pins 73, 75 one-half weight.

Referring again to FIG. 3, the chains 31*c*, 31*d* extend along first and second axes 109, 111, respectively, and define a fleet angle A2 between them. Similarly, the pickup links 47*a*, 47*b* are angled to one another and define what is termed a link angle LA between them and the link angle LA is substantially equal to the fleet angle A2. As will become more apparent, angling the pickup links 47*a*, 47*b* to one another helps reduce the fleet angle A2, among other advantages.

Figure 8:
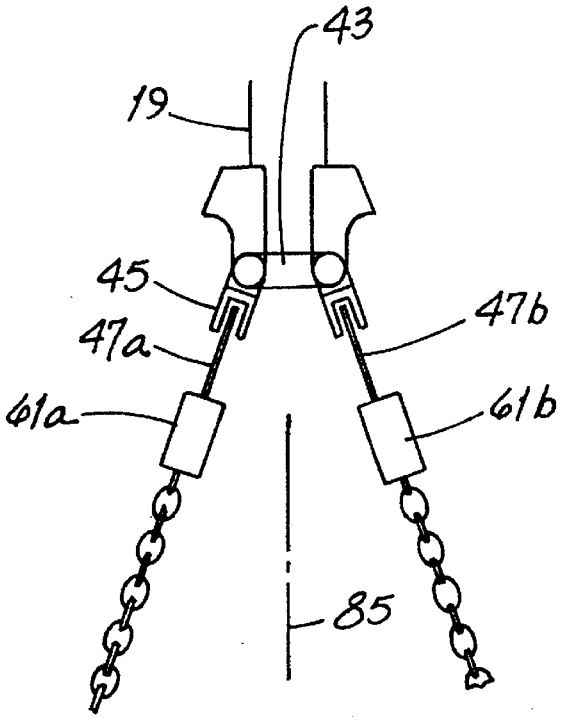
FIG. 8 is front elevation view generally like that of FIG. 3 and showing the orientation of dump blocks with respect to the new rigging assembly. Parts are broken away.
Figure 4:
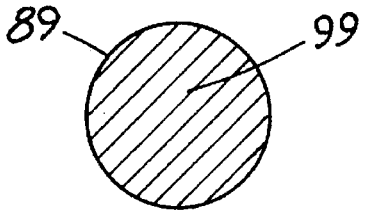
FIGS. 4, 5, 6 and 7 are cross-sectional view of various pins used with the inventive rigging assembly.
Figure 5:
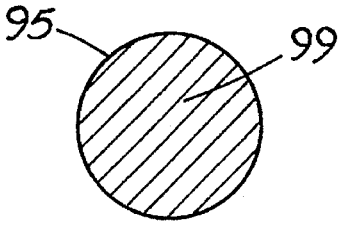
Figure 6:
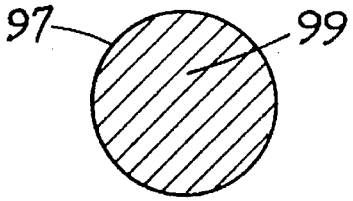
Figure 7:
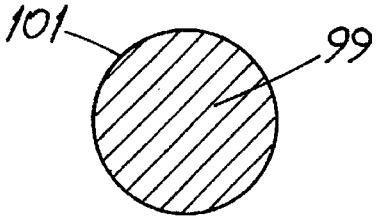

As shown in FIG. 8 (and comparing with FIG. 12), the new assembly 10 also has advantages for dump block orientation and consequent reduced rope wear. Such assembly 10 has first and second dump blocks 61*a*, 61*b* attached to the first and second pickup links 47*a*, 47*b*, respectively. The dump blocks 61*a*, 61*b* are angled with respect to the above-noted vertical plane 85 rather than being parallel thereto as in certain prior art configurations, e.g., that of FIG. 12.

Such dump block orientation improves the life of the dump blocks 61 and rope 29 passing through them since each block 61 is substantially aligned with its respective connection point 115, 117, on the bucket 25 and drag yoke 67, respectively. Therefore, the path travelled by a dump block rope 29 is generally aligned with the block 61, with such point 115 and with the rope connection point 117 on the drag yoke 67. This arrangement has very favorable implications for improving the life of the dump block 61 and dump rope 29.

From the foregoing, it is now apparent that when the prior art arrangement of FIG. 9 and the arrangement of FIG. 3 involving the new rigging assembly 10 are configured so that the dimensions D1 and D2 from the equalizer 43 to the bottom of the bucket 25 are equal to one another, the fleet angles A1 and A2, respectively, are noticeably different. Specifically, the fleet angle A1 of the prior art arrangement in FIG. 9 is over 60° by measurement and the fleet angle A2 of the new arrangement in FIG. 3 is about 40°. And, of course, the smaller fleet angle A2 is much preferred.

While the principles of the invention have been shown and described in connection with but a few preferred embodiments, it is to be understood clearly that such embodiments are by way of example and are not limiting.

What is claimed:

1. In a bucket rigging assembly having first and second hoist sockets, first and second hoist chains coupled to a bucket and first and second pickup links above the hoist chains and wherein the chains extend along first and second axes, respectively, and define a fleet angle therebetween, the improvement wherein:

the rigging assembly includes first and second links, and each of the first and second links and first and second pickup links has an upper end and a lower end;

horizontally-spaced upper pins are coupled to the upper ends of the first and second links, respectively, thereby permitting the first and second links to pivot with respect to a respective one of the horizontally-spaced upper pins;

the lower ends of the first and second links are coupled by respective link pins to respective upper ends of the pickup links;

the pickup links are free to pivot with respect to a respective one of the link pins and define a link angle therebetween which is substantially equal to the fleet angle;

the upper pins are coupled to the first and second hoist sockets, respectively;

the first and second hoist chains are coupled by chain pins to the first and second pickup links, respectively; and the upper pins, the link pins and the chain pins have substantially equal cross-sectional areas.

2. In a bucket rigging assembly having a hoist chain supporting a bucket, a pickup link above the hoist chain, and a hoist socket above the pickup link and wherein the bucket is coincident with a vertical reference plane, the improvement wherein:

the hoist chain and the pickup link extend along an axis angled to the plane;

the assembly has a twisted link having an upper end connected to the hoist socket by a socket pin and also having a lower end;

the pickup link has an upper end which is pivot-coupled by a pickup link pin to the lower end of the twisted link;

the pickup link has a lower end and the hoist chain is pivot-coupled with respect to the pickup link lower end by a chain pin;

the twisted link extends along the axis; and the pins have substantially equal cross-sectional areas.

3. The assembly of claim 2 wherein the hoist chain is an upper hoist chain and the assembly includes a lower hoist chain and wherein:

the upper and lower hoist chains are coupled with respect to one another by a chain-coupling pin; and the pins have substantially equal cross-sectional areas.

* * * * *